United States Patent [19]

Penird et al.

[11] 4,318,025

[45] Mar. 2, 1982

[54] SHADOW MASK MICROPHONIC SUPPRESSOR

[75] Inventors: Carl W. Penird, Waterloo; Richard A. Tamburrino, Auburn, both of N.Y.

[73] Assignee: North American Philips Consumer Electronics Corp., New York, N.Y.

[21] Appl. No.: 96,359

[22] Filed: Nov. 21, 1979

[51] Int. Cl.[3] ..... H01J 29/07

[52] U.S. Cl. ..... 313/404; 313/407

[58] Field of Search ..... 313/402, 404, 406, 407

[56] References Cited

U.S. PATENT DOCUMENTS

| | | | |
|---|---|---|---|
| 3,346,753 | 10/1967 | Haas | 313/404 |
| 3,370,192 | 2/1968 | Schwartz et al. | 313/404 X |
| 3,506,867 | 4/1970 | Kraner | 313/407 |
| 3,808,492 | 4/1974 | Nagao | 313/407 |
| 4,209,727 | 6/1980 | Hausheer | 313/404 |

*Primary Examiner*—Palmer C. Demeo

*Assistant Examiner*—Darwin R. Hostetter

[57] ABSTRACT

Microphonic suppressors are included in a color cathode ray tube. The suppressors are attached to the shadow mask and extend within the space between the mask and tube wall. One end of the suppressor contacts the tube wall. Constructed of spring-like material, the suppressors absorb sound waves generated within the television receiver before these sound waves can cause vibration of the shadow mask.

1 Claim, 4 Drawing Figures

SHADOW MASK MICROPHONIC SUPPRESSOR

TECHNICAL FIELD

This invention relates to color cathode ray tubes employing shadow masks or parallax barriers and more particularly to means for preventing microphonic vibration of the shadow mask during tube operation.

BACKGROUND ART

Recent changes in color television receivers have included improved sound systems with greater fidelity and increased low range or bass audio responsiveness. The vibrations stemming from these sound systems have been found to cause vibrations in the shadow-mask-frame assembly of color tubes, causing an objectionable optical effect stemming from mis-registration of the electron beam upon the phosphor landing areas.

DISCLOSURE OF THE INVENTION

It is therefore an object of this invention to obviate the disadvantages of the prior art.

It is another object of the invention to provide an improved color picture tube.

These objects are achieved in one aspect of the invention by the provision, in a color cathode ray tube employing a shadow mask, of a microphonic suppressor fixedly attached to the shadow mask and contacting the internal wall of the tube.

The microphonic suppressor absorbs sound generated vibrations before they can be picked up by the shadow mask, thus eliminating the objectionable optical problems.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
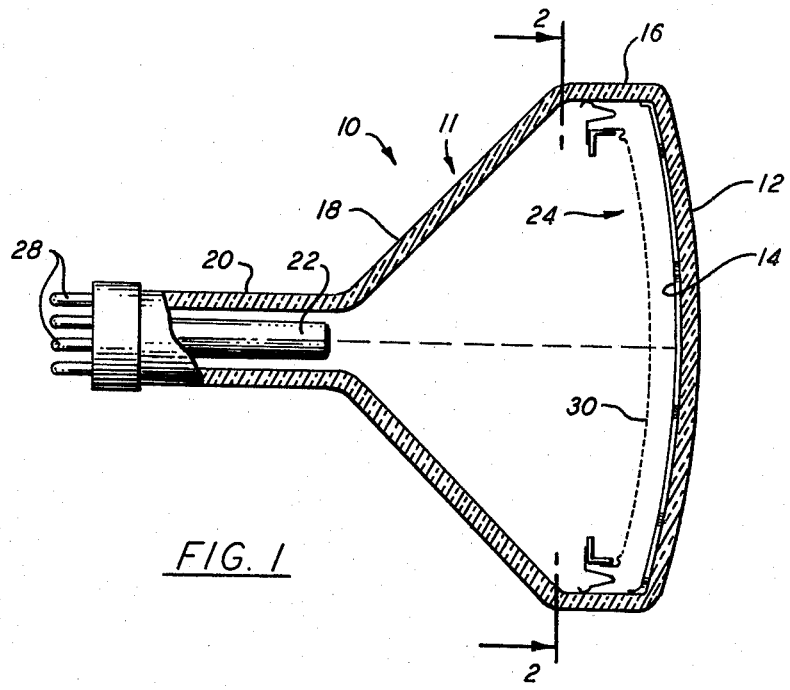
FIG. 1 is a sectional view of a color cathode ray embodying the invention.

Referring now to the drawings with greater particularity, there is shown in FIG. 1 a color cathode ray tube 10 having an evacuated envelope 11 including a face plate 12 with a patterned phosphor screen 14 disposed on the interior surface thereof. A peripheral side wall 16 extends from the face plate 12 and joins a substantially funnel-shaped body 18. The narrow end of the funnel terminates in a cylindrical neck 20 which encloses an electron source 22 in the form of one or more electron guns. A shadow mask assembly or parallax barrier 24 is releasably mounted within the tube adjacent the screen portion by a plurality of leaf springs 26. The tube is evacuated as is conventional in the art and is provided with suitable leads 28 for making electrical connection to the proper components.

The shadow mask assembly 24 comprises a relatively fragile apertured portion 30 which is affixed at its peripheral edge 32 to a relatively rigid frame 34. The frame 34 is substantially "L" shaped in cross-section and provides a side wall 36, which is substantially parallel to tube side wall 16 when the mask assembly is mounted in the tube, and an inwardly extending flange 38.

When mounted in the tube a space exists between frame side wall 36 and tube side wall 16, which space accommodates the leaf springs 26 and the mounting studs 40 with which they cooperate.

To accomplish the objects of the invention there is provided within tube 10 at least one microphonic suppressor 42. Generally, the microphonic suppressor 42 is attached to mask assembly 24 and extends into the space between the mask assembly 24 and tube side wall 16. The suppressor 42 is detailed in FIGS. 3 and 4.

Figure 3:
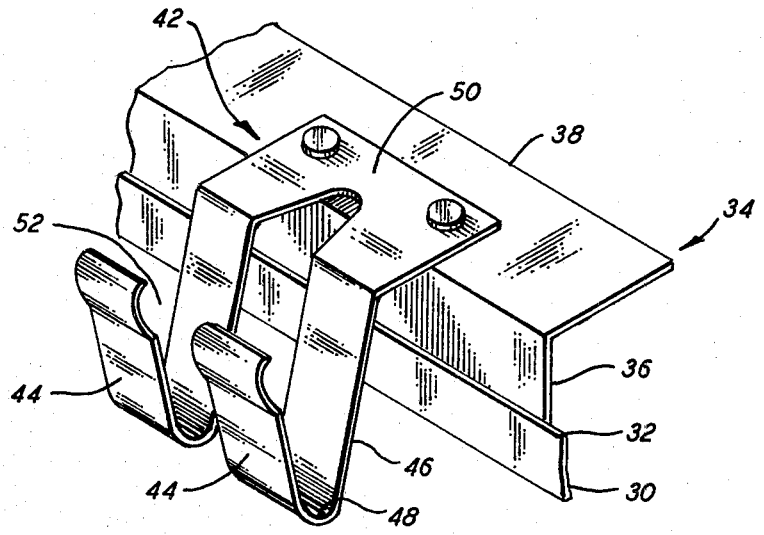
FIG. 3 is a partial perspective view illustrating the invention.
Figure 4:
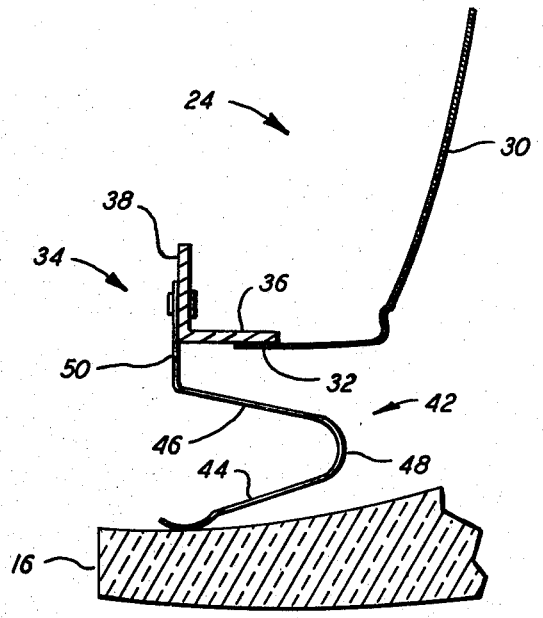
FIG. 4 is a partial, elevational section of the invention.

Therein, and referring particularly to FIG. 3, it will be seen that suppressor 42 comprises two separated legs 44 and 46 connected by a bight 48. One of the legs, in this instance 46, is provided with an attachment flange 50 which is fixedly attached as by welding or riveting to mask assembly 24; preferably to flange 38 thereof.

At least leg 44 is preferably bifurcated as at 52 and the terminal portions of the leg can be provided with contacting dimples 54 which firmly engage the tube side wall 16.

Figure 2:
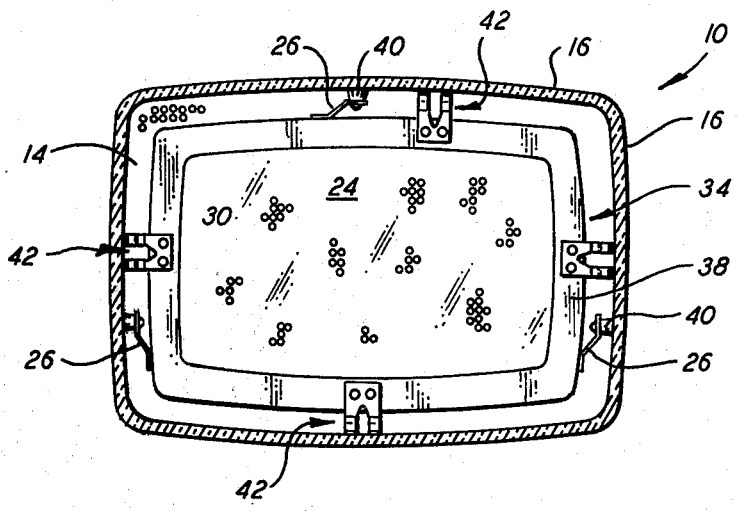
FIG. 2 is a sectional view taken along the line 2—2 of FIG. 1.

Suppressor 42 is constructed of a suitable spring-like material and as many as deemed necessary can be employed. In FIG. 2 four such suppressors 42 are shown, one on each side of the mask assembly.

Employment of the suppressors effectively reduces or eliminates the unwanted optical distortion generated by sound induced vibrations in the shadow mask assembly.

While there has been shown and described what are at present considered to be the preferred embodiments of the invention, it will be apparent to those skilled in the art that various changes and modifications can be made herein without departing from the scope of the invention as defined by the appended claims.

We claim:

1. In a color cathode ray tube having an evacuated envelope with a face plate and sidewalls and including a shadow mask mounted adjacent said face plate and supported by springs from said sidewalls, said shadow mask having a frame including an inwardly directed flange, the improvement comprising: at least one substantially U-shaped microphonic suppressor having two separated legs connected by a bite, one of said legs being provided with a mask attachment flange, said flange fixedly attached to said mask flange, said bite extending toward said face plate, and the other of said legs projecting into a space between the mask and the sidewall and firmly contacting the sidewall, at least the sidewall-contacting leg being bifurcated.

* * * * *